US007021116B2

(12) United States Patent
Harrington et al.

(10) Patent No.: US 7,021,116 B2
(45) Date of Patent: Apr. 4, 2006

(54) PRESS BRAKE TOOLING TECHNOLOGY

(75) Inventors: Heath E. Harrington, Coon Rapids, MN (US); Patrick J. Campbell, Coon Rapids, MN (US); Paul T. Johnson, Stillwater, MN (US); Bryan L. Rogers, Forest Lake, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 10/742,439

(22) Filed: Dec. 19, 2003

(65) Prior Publication Data

US 2005/0132772 A1 Jun. 23, 2005

(51) Int. Cl.
*B21D 37/04* (2006.01)

(52) U.S. Cl. ..... 72/482.91; 72/389.3; 72/482.92; 72/481.1

(58) Field of Classification Search ..... 72/389.9, 72/481.1, 482.6, 482.91, 482.92, 389.3, 481.6
See application file for complete search history.

(56) References Cited

U.S. PATENT DOCUMENTS

| | | | | |
|---|---|---|---|---|
| 2,755,758 | A | 7/1956 | Johansen | 113/49 |
| 3,779,122 | A | 12/1973 | Sawvell | 83/698 |
| 4,534,203 | A | 8/1985 | Cros | 72/481 |
| 4,787,237 | A | 11/1988 | Houston et al. | 72/462 |
| 4,993,255 | A | 2/1991 | Treillet | 72/462 |
| 5,009,098 | A | 4/1991 | van Merksteijn | 72/839 |
| 5,042,352 | A | 8/1991 | Lux | 83/690 |
| 5,245,854 | A * | 9/1993 | Bruggink et al. | 72/481.7 |
| 5,460,027 | A | 10/1995 | Takahashi | 72/481 |
| 5,642,642 | A | 7/1997 | Kawano | 72/482.91 |
| 5,782,308 | A | 7/1998 | Latten et al. | 72/481.6 |
| 5,794,486 | A | 8/1998 | Sugimoto et al. | 72/481.1 |
| 6,003,360 | A | 12/1999 | Runk et al. | 72/482.2 |
| 6,138,492 | A | 10/2000 | Vining et al. | 72/481.1 |
| 6,463,839 | B1 | 10/2002 | Ohtsuka et al. | 83/698.91 |
| 6,467,327 | B1 * | 10/2002 | Runk et al. | 72/481.1 |
| 6,494,075 | B1 | 12/2002 | Pelech, Jr. | 72/481.1 |
| 6,644,090 | B1 * | 11/2003 | Gasparini | 72/482.2 |
| 2003/0221476 | A1 | 12/2003 | Sperrer | 72/481.6 |

FOREIGN PATENT DOCUMENTS

| | | | | |
|---|---|---|---|---|
| AT | 13832002 | | 11/2003 | |
| DE | 3136-440 | * | 3/1983 | 72/482.91 |
| DE | 4115224 | A1 | 11/1992 | |
| DE | 195 13 576 | | 4/1995 | |
| DE | 198 45 386 | A1 | 5/2000 | |
| DE | 10054644 | A1 | 5/2001 | |

(Continued)

*Primary Examiner*—David Jones
(74) *Attorney, Agent, or Firm*—Fredrikson & Byron, PA

(57) ABSTRACT

The invention provides press brake and press brake tooling technology. Certain embodiments of the invention provide a press brake tool that has an elongated, retractable safety key. In certain embodiments, the invention provides click-in/slide-out press brake tools. In some of these embodiments, the tool has a safety key defining a flat (i.e., a planar wall section/planar surface) that is adapted for sliding along a surface of a tool holder when the tool is dismounted from the holder by moving the tool horizontally out of the holder. In certain embodiments, the flat has a longitudinal length of at least about 0.008 inch (in some cases, at least about 0.010 inch, at least about 0.015 inch, or at least about 0.020 inch), ranging up to the full longitudinal length of the tool. In certain embodiments, the invention provides a press brake tool and a tool holder in combination. Finally, the invention in some embodiments provides methods of press brake operation.

14 Claims, 16 Drawing Sheets

FOREIGN PATENT DOCUMENTS

| | | |
|---|---|---|
| EP | 0 119 108 | 9/1984 |
| EP | 0 237 800 | 9/1987 |
| EP | 0 256 245 | 2/1988 |
| EP | 1 169 151 B | 12/2002 |
| FR | 2122977 | 9/1972 |
| FR | 2 416 064 | 2/1978 |
| FR | 2 598 946 | 11/1987 |
| JP | 9100034 | 12/1982 |
| JP | 57089929 | 12/1982 |
| RU | 741999 | 11/1977 |
| WO | WO 02/13985 A | 2/2002 |
| WO | WO 2004/024361 A1 | 3/2004 |

* cited by examiner

PRESS BRAKE TOOLING TECHNOLOGY

FIELD OF THE INVENTION

The present invention relates generally to industrial presses and tools. More particularly, this invention relates to press brakes and press brake tools.

BACKGROUND OF THE INVENTION

Press brakes are commonly used to bend sheet-like workpieces, such as sheet metal. A conventional press brake has an upper beam and a lower beam, at least one of which is movable toward and away from the other. Typically, the upper beam is movable vertically while the lower beam is fixed in a stationary position. It is common for a male forming punch and a female forming die to be mounted respectively on the upper and lower beams of a press brake.

Typically, the punch has a downwardly-oriented, workpiece-deforming surface (or "tip"). The configuration of this surface is dictated by the shape into which it is desired to bend a workpiece. The die typically has a recess that is aligned with the tip of the punch. The configuration of this recess corresponds to the configuration of the workpiece-deforming surface of the punch. Thus, when the beams are brought together, a workpiece between the two is pressed by the punch into the die to give the workpiece a desired bend.

From time to time, it is necessary to mount and dismount press brake tools. The manner in which a press brake tool is mounted on, and dismounted from, a tool holder depends upon the configuration of the tool. For example, U.S. Pat. No. 5,245,854 (issued to Bruggink et al., and assigned to Mechinefabriek Wila B. V.), the entire teachings of which are incorporated herein by reference, discloses a punch that is adapted for both vertical mounting and vertical dismounting. Here, the punch has a projection P that is biased by a spring toward an extended position in which the projection P extends outwardly through an opening in the side surface of the punch's tang. When the projection P is in its extended position, it P is adapted to engage a safety slot S/S defined by the tool holder. The punch has an actuator (a button) that is connected to the spring-biased projection P such that when the actuator is actuated (when the button is depressed), the projection P is moved (overcoming the bias of the spring) to its retracted position. When the projection P is retracted, the punch can be moved upwardly for mounting or downwardly for dismounting.

In more detail, the punch taught in this Wila patent is mounted by moving it upwardly into the downwardly-open channel of the tool holder (while the projection P is held in its retracted position by depressing the button). Once the punch is moved into its operative position (wherein the tang of the punch is received in the channel of the tool holder), the actuator is disengaged (by releasing the button) and the bias of the spring moves the projection P into its extended position so as to engage the safety slot S/S of the tool holder. Later, when it is desired to dismount the punch, the actuator is again actuated to retract the projection P, causing it P to disengage from the safety slot S/S of the tool holder, whereafter the punch can be removed downwardly out of the channel of the tool holder.

Thus, the punch in this Wila patent can be removed from the tool holder by moving the punch downwardly while the projection P retracted. While vertical dismounting is quite desirable in some cases, it can be a significant disadvantage in certain respects. For example, when the actuator on the punch is actuated (by depressing the button), the full weight of the tool is instantaneously released upon the operator. In some cases, this is less than ideal, such as when heavier (e.g., longer) tools are used.

On heavier tools, Wila provides one or more fixed dowels on each tool. Consequentially, these tools are dismounted by sliding them lengthwise out of the tool holder, rather than by removing them downwardly. This is advantageous in that it avoids the sudden release of the tool's full weight upon the operator. Unfortunately, these tools must also be mounted horizontally due to the fixed dowels. It is desirable to be able to mount press brake tools by moving them upwardly from below the upper table of a tool holder and, unlike dismounting, mounting normally does not involve any sudden release of the tool's weight.

Further, the fixed dowels on these Wila tools are circular in cross section. Unfortunately, these round dowels tend to deform (e.g., gouge) the planar beam surface on which the dowels slide when a punch of this nature is removed from a tool holder. This is because the weight of the punch is effectively concentrated on the one or more single points of contact that exist between the round dowels and the planar beam surface on which the dowels slide. This can cause unnecessary beam damage and therefore is less than ideal.

It would be desirable to provide a press brake tool that can be mounted vertically, and can be dismounted horizontally (i.e., by sliding the tool lengthwise from the tool holder), but cannot be dismounted vertically. It would be particularly desirable to provide a tool of this nature wherein the contact between tool and the beam surface on which the tool slides during removal is broader than just one or more single points of contact (e.g., wherein the tool has one or more safety keys each defining a flat adapted to slide along a surface of the beam during removal), such that beam deformation is less likely when the tool is dismounted.

SUMMARY OF THE INVENTION

In certain embodiments, the present invention provides a press brake tool that is adapted for being mounted in a tool holder by moving the tool vertically into a channel defined by the tool holder This tool is adapted for being dismounted from the tool holder by moving the tool horizontally out of the channel. The tool, however, is not adapted for being dismounted from the tool holder by moving the tool vertically out of the channel. The tool has a shank provided with a safety key. In the present embodiments, the safety key is biased toward an extended position when the shank is moved to an operative position in the channel of the tool holder. Preferably, the tool here has no externally accessible actuator for retracting the safety key, such that once the tool's shank is moved into its operative position in the channel of the tool holder a press brake operator is prevented from retracting the safety key and removing the tool vertically from the tool holder.

In certain embodiments, the invention provides a press brake tool that is adapted for being mounted in a tool holder by moving the tool vertically into a channel defined by the tool holder. This tool is adapted for being dismounted from the tool holder by moving the tool horizontally out of the channel. However, the tool is not adapted for being dismounted by moving the tool vertically out of the channel. The tool has a shank provided with a safety key. In these embodiments, the safety key is biased toward an extended position when the shank is moved to an operative position in the channel of the tool holder. In these embodiments, the tool preferably has no externally accessible actuator for retracting the safety key such that once the tool's shank is moved into its operative position a press brake operator is prevented from retracting the safety key and removing the tool vertically from the tool holder. In these embodiments, the safety key defines a flat adapted to slide along a planar surface of the tool holder when the tool is dismounted from the tool holder by moving the tool horizontally out of the channel.

Certain embodiments of the invention provide a press brake tool that is adapted for being mounted in a tool holder by securing a shank of the tool in a channel defined by the tool holder. In the present embodiments, the tool's shank is provided with a retractable safety key. In these embodiments, the tool's shank has a longitudinal length and the retractable safety key spans substantially the entire longitudinal length of the tool's shank.

The invention also provides embodiments comprising a press brake tool and tool holder in combination. Here, the press brake tool has a shank mounted in a channel defined by the tool holder. The shank has a retractable safety key. The safety key is in an extended position and is engaged with a safety slot defined by the tool holder. Preferably, in these embodiments, the tool has no externally accessible actuator for retracting the extended safety key, such that a press brake operator is prevented from retracting the safety key and removing the thus operatively positioned tool vertically from the tool holder.

Certain embodiments of the invention provide a method of press brake operation. The method comprises: (a) providing a press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted by moving the tool vertically out of the channel, the tool having a shank that is provided with a safety key, wherein the safety key is biased toward an extended position when the shank is moved to an operative position in the channel of the tool holder, and wherein the tool has no externally accessible actuator for retracting the safety key, such that once the tool's shank is moved into its operative position a press brake operator is prevented from retracting the safety key and removing the tool vertically from the tool holder; (b) providing a tool holder that defines a channel and a safety slot; and (c) mounting the press brake tool in the tool holder by moving the tool vertically into an operative position in the channel of the tool holder, such that the safety key is biased toward, and thereby moved into, an extended position wherein the safety key is engaged with the safety slot. In certain embodiments, this method further comprises dismounting the tool from the tool holder by moving the tool horizontally out of the channel.

In certain embodiments, the invention provides a press brake tool adapted for being mounted in a tool holder by moving the tool vertically upwardly into a downwardly open channel of the tool holder. The tool is adapted for being dismounted from the tool holder by moving the tool horizontally out of the channel. In these embodiments, the tool comprises a body and a shank, wherein the shank arises from the body and is fully receivable in the channel of the tool holder. Here, the shank carries a safety key that is spring-biased toward an extended position for engaging a shoulder of the channel to prevent downward movement of the tool when the shank is fully received in the channel. In these embodiments, the body of the tool is devoid of any manually operable externally accessible mechanism for retracting the safety key such that when the tool is fully received in the channel a press brake operator is without means for retracting the safety key and removing the tool vertically downwardly from the tool holder.

Certain embodiments provide a press brake tool and a tool holder therefore. In these embodiments, the tool holder has a downwardly open channel with an interior shoulder. Here, the tool comprises a body and a shank, wherein the shank arises from the body and is fully receivable in the channel of the tool holder. In these embodiments, the shank carries a safety key that is spring-biased toward an extended position to engage the shoulder of the channel to prevent downward movement of the tool when the shank is fully received in the channel. In these embodiments, the body of the tool is devoid of any manually operable readily accessible mechanism for retracting the safety key such that when the tool is fully received in the channel a press brake operator is without means for retracting the safety key and removing the tool vertically downwardly from the tool holder.

DETAILED DESCRIPTION OF PREFERRED EMBODIMENTS

The invention provides press brake tools that are adapted for being mounted on a tool holder by moving the tool vertically into a channel defined by the tool holder, and for being dismounted from the tool holder by moving the tool horizontally (i.e., by sliding the tool lengthwise) out of the channel. Press brake tools of this nature are referred to herein as click-in/slide-out tools. Preferably, when these tools are mounted in the tool holder they produce an audible "click" sound upon reaching their operative position. In preferred embodiments, this sound results when the safety key(s) on the tool snaps into place in a safety slot defined by the tool holder, as detailed below. It is to be understood that this audible clicking is a preferred feature, which is by no means required for all embodiments of the invention.

The Wila tool described above is a click-in/click-out tool. In other words, it is adapted for both vertical mounting (i.e., mounting by moving the tool vertically into the channel of the tool holder) and vertical dismounting (i.e., dismounting by moving the tool vertically out of this channel). As noted above, vertical dismounting has the disadvantage that it suddenly releases the full weight of the tool on the operator. This can be less than ideal in some cases, such as when particularly heavy tools are used. In contrast, the present tool is not adapted for being dismounted by moving the tool vertically out of the tool holder's channel. Rather, this tool is adapted to prevent vertical dismounting, as described below.

Figure 1:
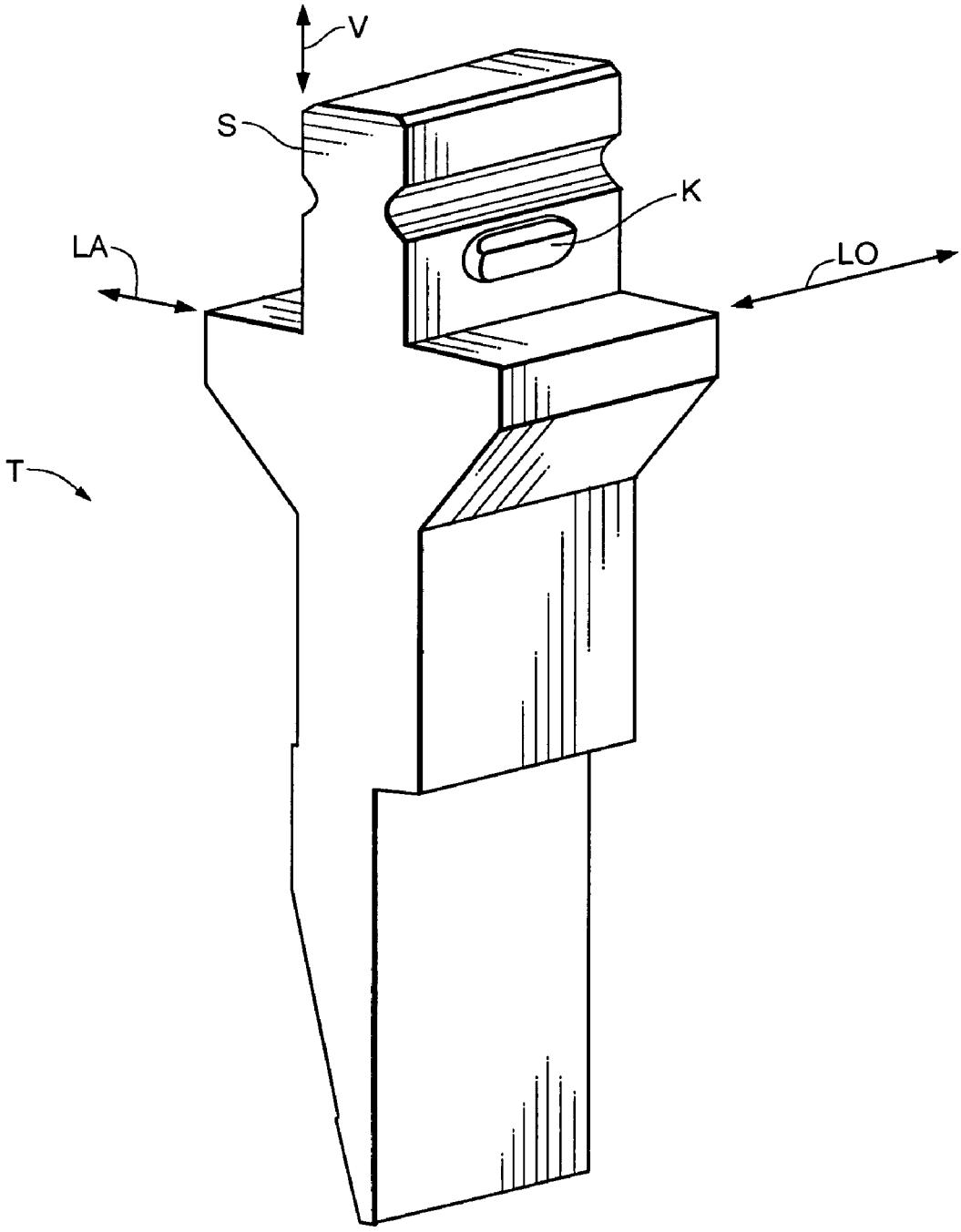
FIG. 1 is a perspective view of a press brake tool in accordance with certain embodiments of the present invention.
Figure 2:
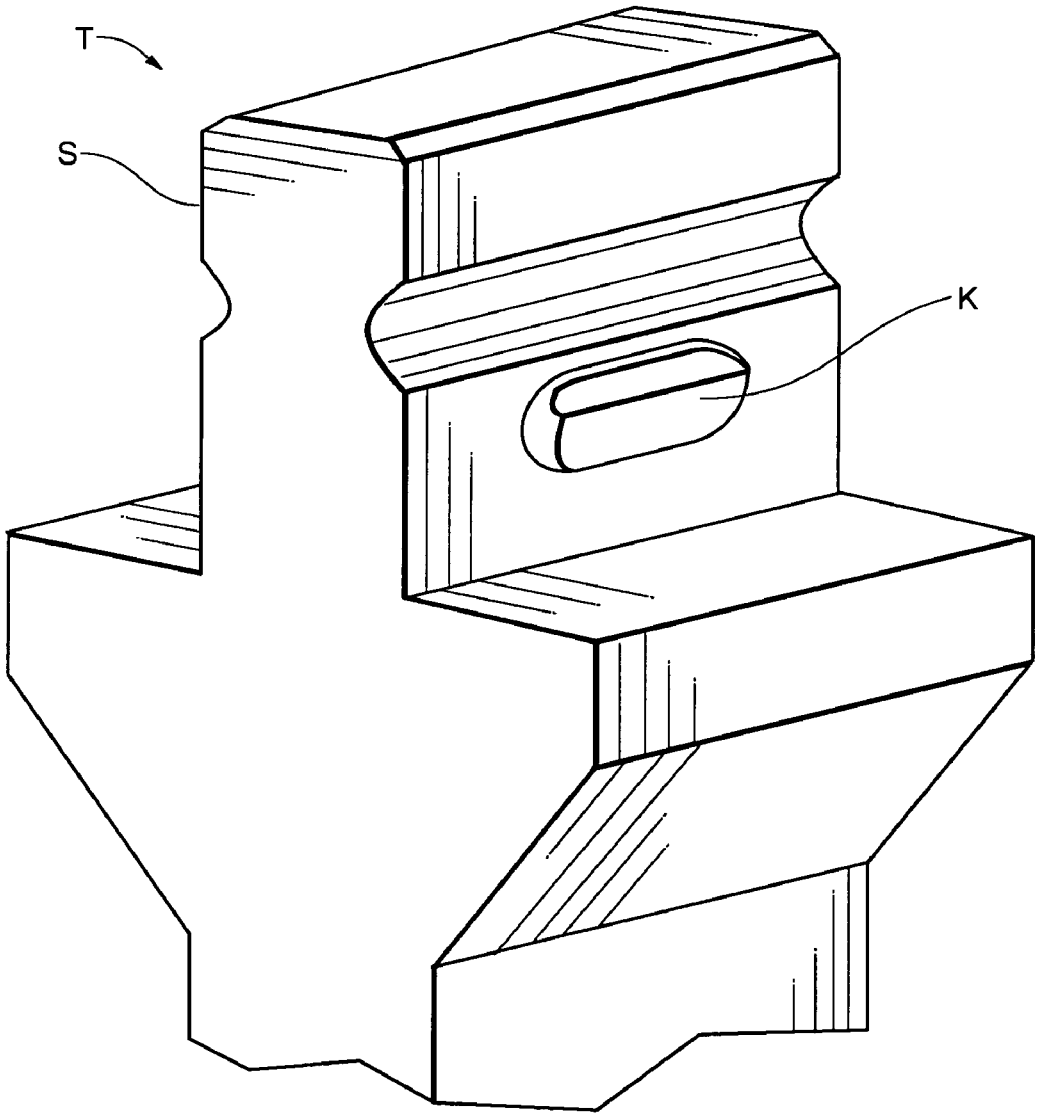
FIG. 2 is a partially broken away perspective detail view of the press brake tool of FIG. 1.
Figure 3:
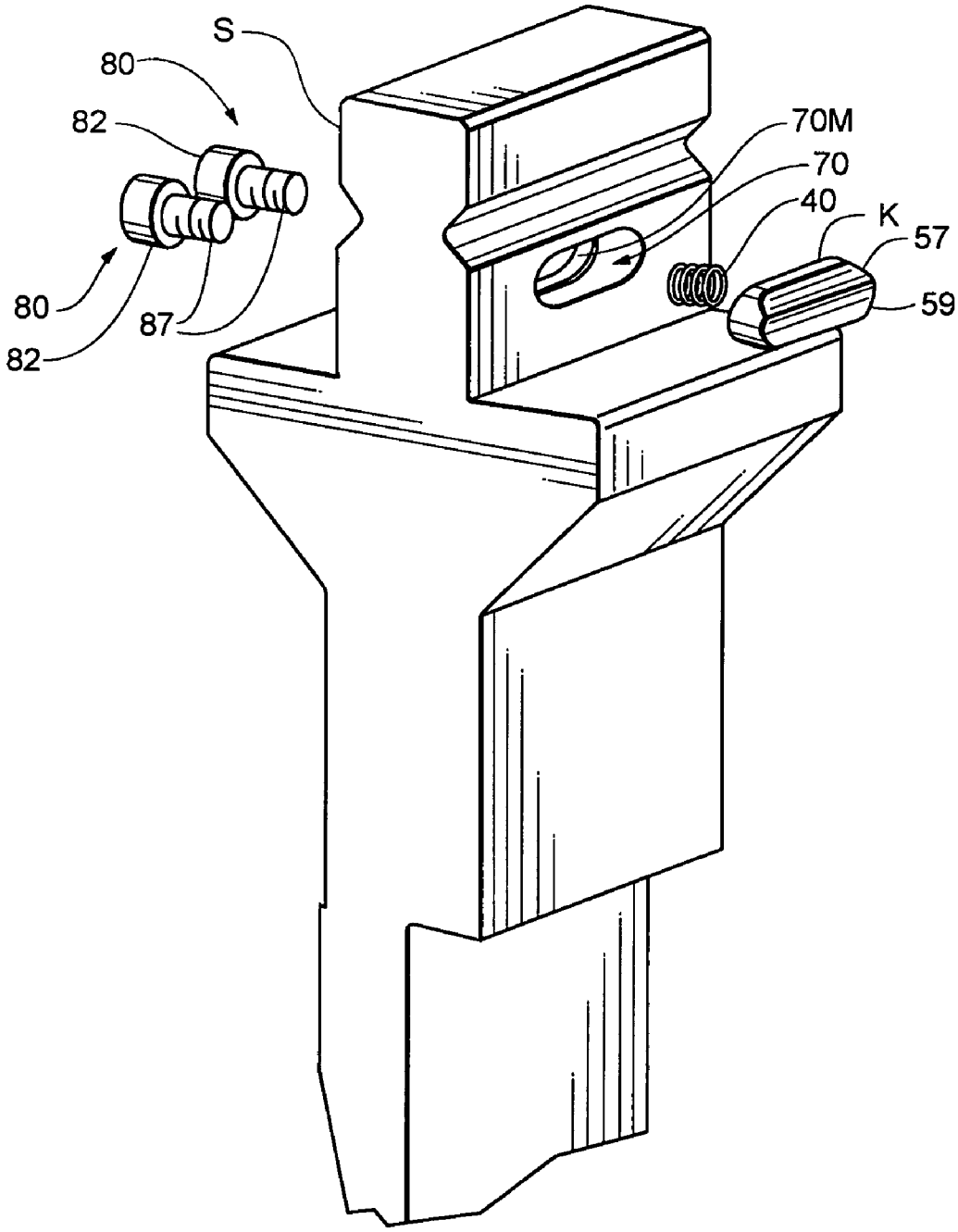
FIG. 3 is a partially broken away exploded perspective view of a press brake tool in accordance with certain embodiments of the invention.
Figure 4:
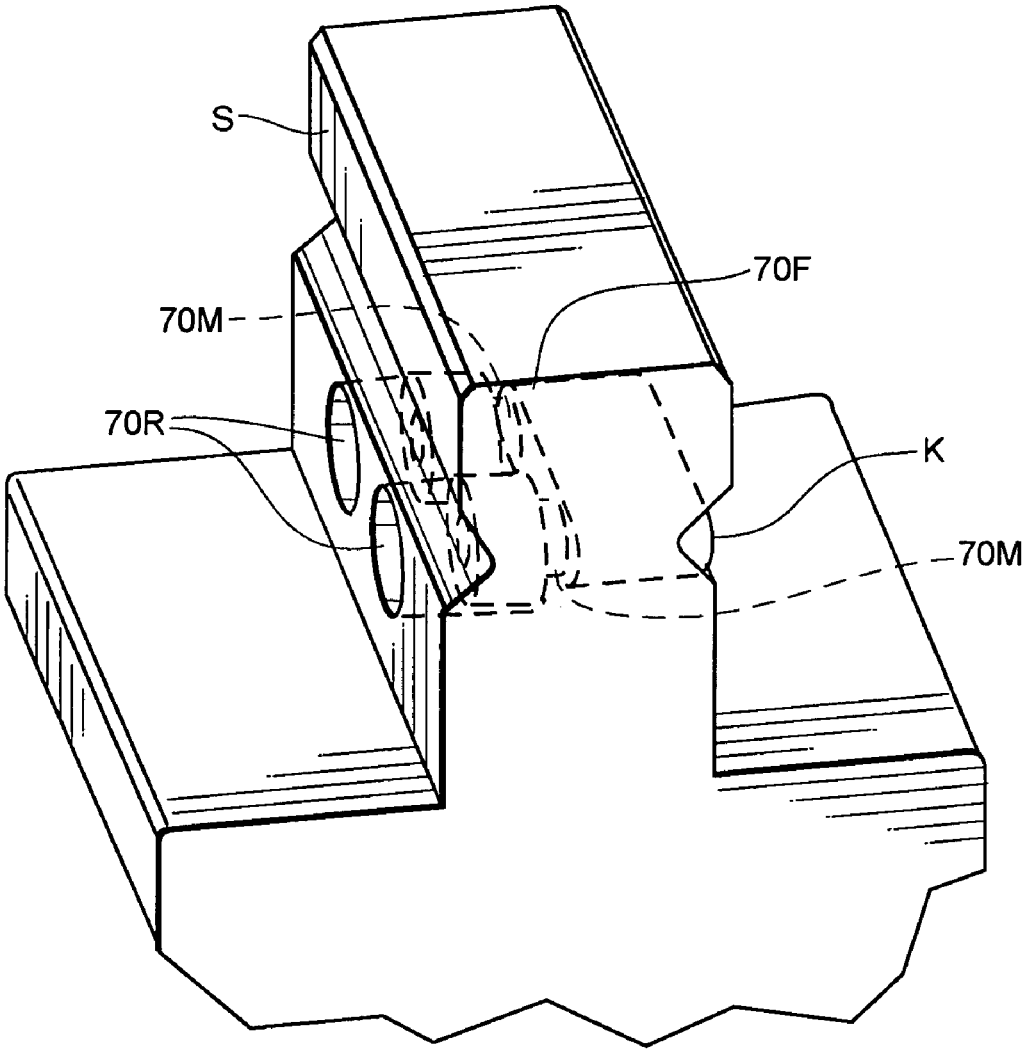
FIG. 4 is a partially broken away perspective schematic view of the press brake tool of FIG. 3.

FIG. 1 depicts a press brake tool T in accordance with certain embodiments the invention. Generally, the tool T has a shank S that is provided with a safety key K. In FIGS. 1–9, the illustrated shank has only one safety key. It is to be understood that the term "tool" is used herein to refer to punches and dies.

Figure 12C:
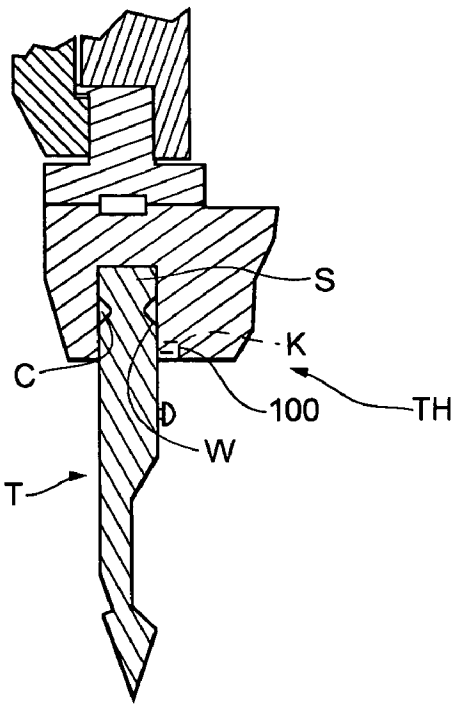
FIG. 12C is a partially broken away cross sectional side view of a press brake tool and tool holder of the Wila style.
Figure 12B:
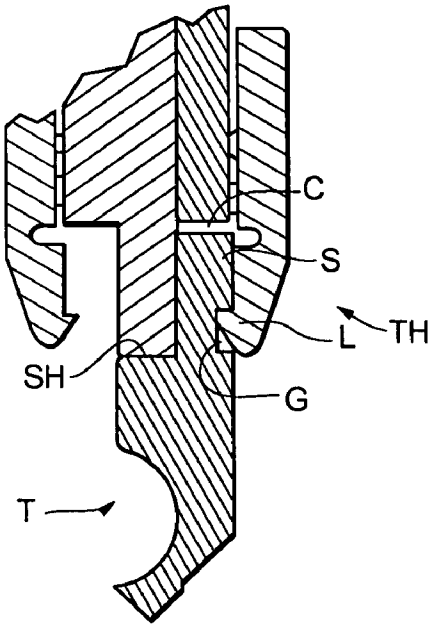
FIG. 12B is a partially broken away cross sectional side view of a press brake tool and tool holder of the European style.

The present tool can be of any basic tooling style, including well-known styles such as the American, Wila, and European styles. Tools of the American and Wila styles are typified respectively in FIGS. 12A and 12C. The European style, which is also well known, is typified in FIG. 12B. The present tool can also take the form of various other tooling styles that are known in the art but are currently in less widespread use. In fact, it will be appreciated that the present tool can be of any tooling style, including styles not yet developed, that would benefit from the features of this invention.

As noted above, the present tool T is adapted to be mounted in the channel C of a tool holder TH. The tool holder TH will commonly be of the American, Wila, or European styles. The tool holder TH, of course, can be a press brake beam, an adaptor mounted to a press brake beam, or any other type of tool holder.

Generally, the shank of the tool is adapted to be mounted in the channel of the tool holder. More particularly, the shank S is sized and shaped to be received (e.g., snuggly received such that the shank is held rigidly in a stationary position relative to the tool holder) in the channel C of the tool holder. Typically, the shank is at one end of the tool and the workpiece-deforming surface (i.e., the tip) is at another end. The shank and the tip commonly are at generally-opposed ends of the tool. In FIGS. 1–9, the illustrated shank has two opposed sides each having formed therein a longitudinally extending groove. Referring again to FIG. 1, it can be appreciated that the tool has a vertical axis V (along which the height of the tool extends), a longitudinal axis LO (along which the length of the tool extends), and a lateral axis LA (along which the width of the tool extends). The specific configuration of the tool, however, will vary with different embodiments.

The safety key K is retractable. That is, it is movable between an extended position and a retracted position. Preferably, the safety key is moveable laterally (i.e., along axis LA) between its extended and retracted positions. In FIGS. 1–9, when the illustrated safety key is extended, it projects from a single side of the tool's shank. When the safety key is in the extended position, it is adapted to engage the tool holder (e.g., by extending into a safety slot 100 defined by the tool holder) to facilitate retention of the tool in the tool holder. Thus, when the safety key is in its extended position, the distal end 59 of the safety key is further (e.g., laterally) from the tool's shank S than when the safety key is in the retracted position. Preferably, the distal end 59 of the safety key when in the extended position is further laterally from the shank than it is when the safety key is in any other position within its range of movement. That is, the safety key K when in its extended position preferably is fully extended. This facilitates full engagement of the safety key to the tool holder.

When the safety key is in the retracted position, the tool is adapted for being disengaged from the tool holder. Thus, when the safety key K is retracted, the distal end 59 of the key K is closer (e.g., laterally) to the shank S than when the key is in the extended position. In certain embodiments, the safety key is fully retracted inside the shank (or at least substantially inside the shank) when the key is in its retracted position. This is typically preferred in Wila-style embodiments and other embodiments wherein the safety key is adapted to extend through an opening in the side surface of the tool shank. In other embodiments, the safety key simply projects away from the shank S to a lesser extent in the retracted position than it does in the extended position (in some cases, the safety key does not project laterally away from the shank at all when in the retracted position). This is typically the case in American-style embodiments and other embodiments wherein the safety key is adapted to project from the top of the shank (here, the top of the shank is that end of the shank that is opposite the tool's tip).

The manner in which the safety key engages the tool holder varies with different embodiments. For example, in Wila-style embodiments, the safety key typically extends through an opening in the side surface of the tool shank S and engages a safety slot 100 in the tool holder. Typically, the safety slot 100 is defined by a vertical wall W of the tool holder TH and extends along that wall W longitudinally (i.e., along axis LO). Generally, the safety slot 100 opens into the mounting channel C that is defined by the tool holder. As noted above, the channel C extends longitudinally and receives the shank of the tool during use.

Figure 12A:
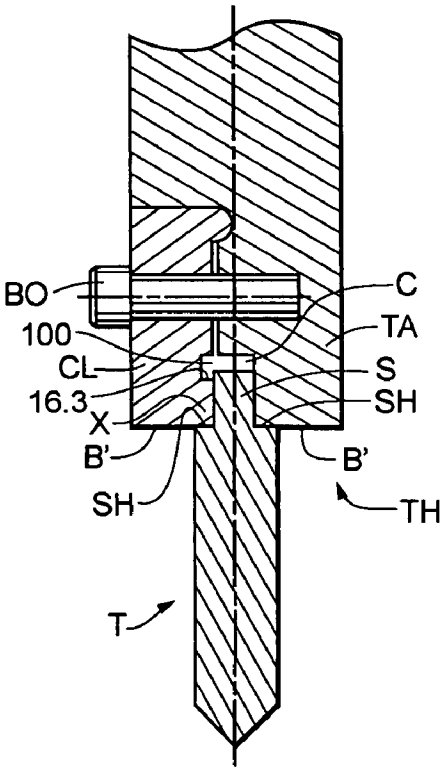
FIG. 12A is a partially broken away cross sectional schematic side view of a press brake tool and tool holder of the American style.
Figure 13A:
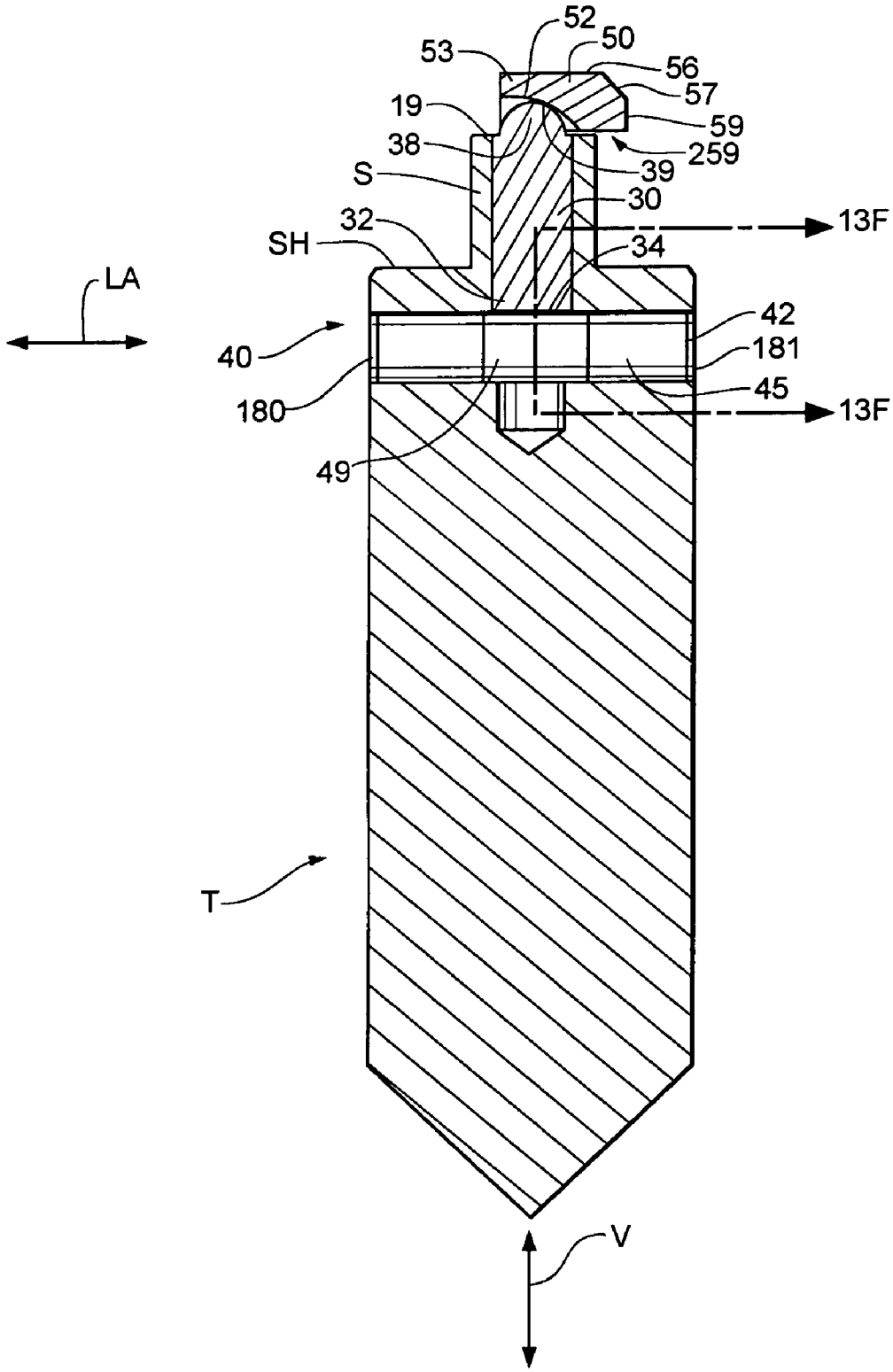
FIG. 13A is a cross sectional schematic side view of a press brake tool in accordance with certain embodiments of the invention.
Figure 13B:
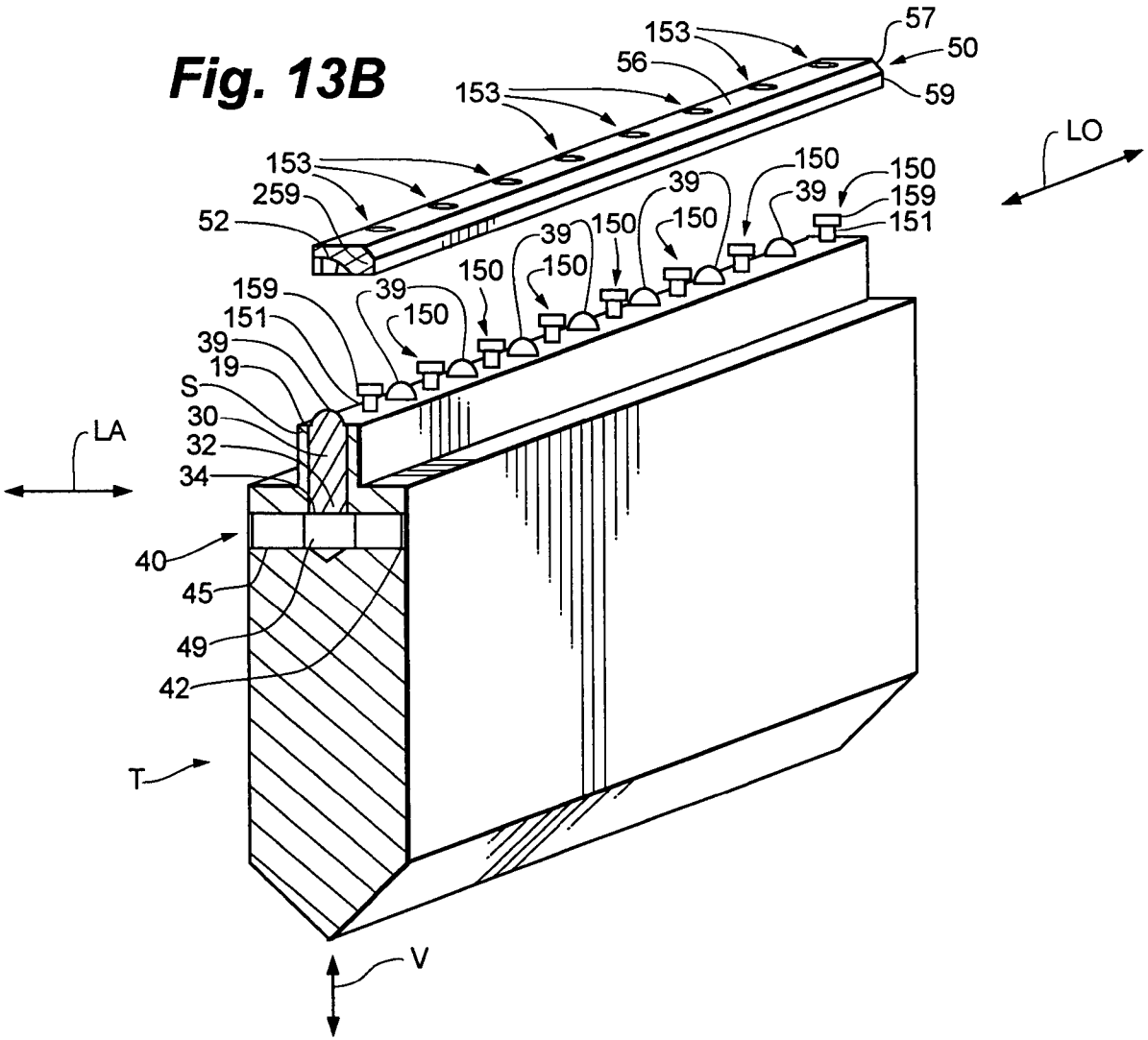
FIG. 13B is a cross sectional partially exploded perspective schematic view of the press brake tool of FIG. 13A.
Figure 13C:
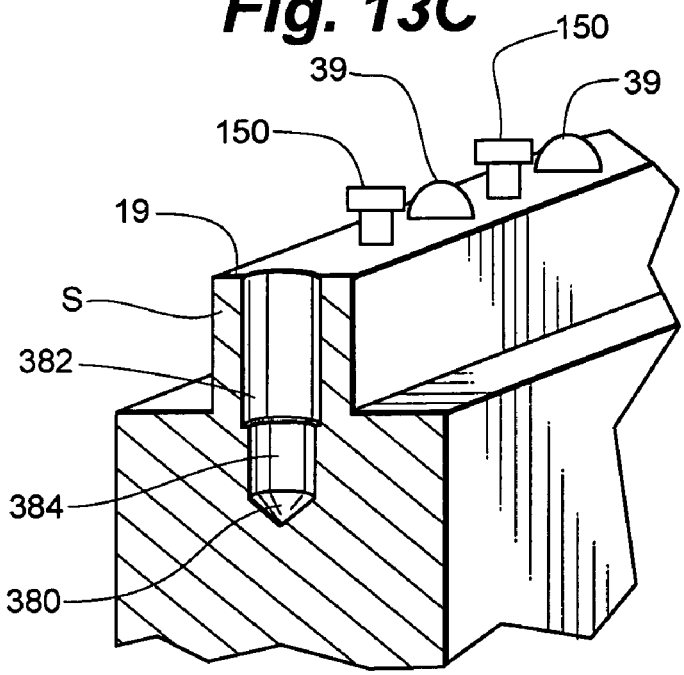
FIG. 13C is a cross sectional partially broken away perspective schematic detail view of the press brake tool of FIG. 13A.
Figure 13D:
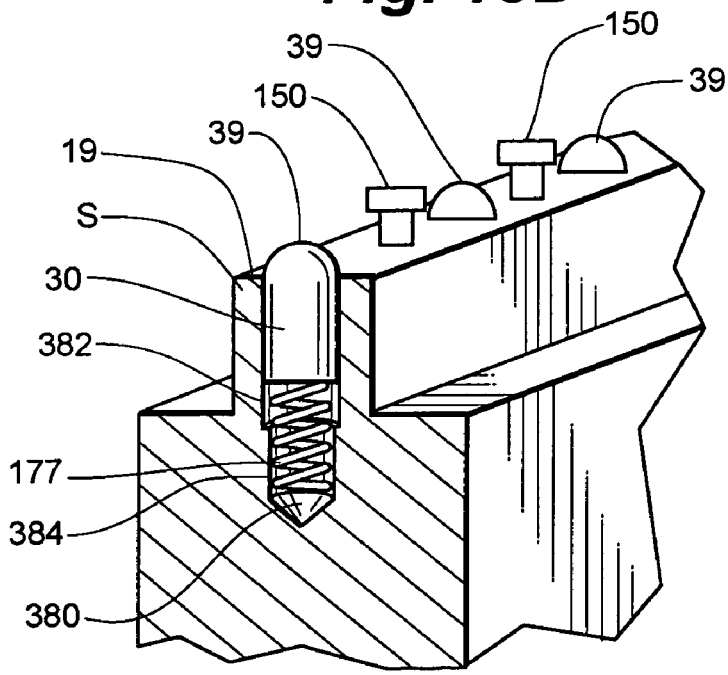
FIG. 13D is a cross sectional partially broken away perspective schematic detail view of the press brake tool of FIG. 13A.
Figure 13E:
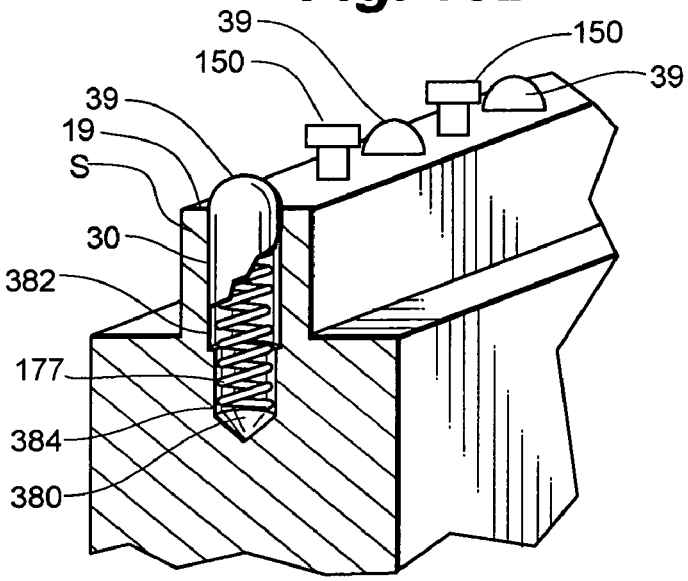
FIG. 13E is still another cross sectional partially broken away perspective schematic detail view of the press brake tool of FIG. 13A.
Figure 13F:
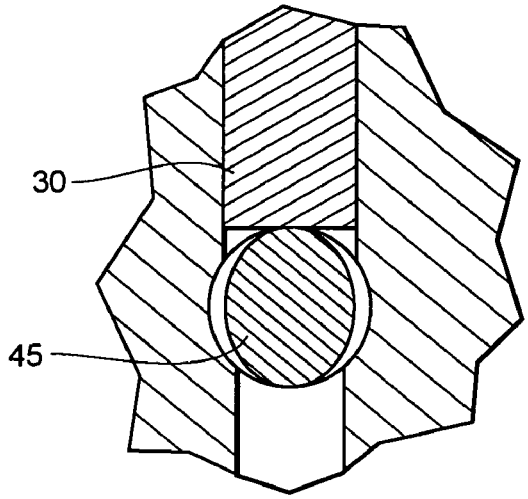
FIG. 13F is a cross sectional side detail view taken along lines 13F of the press brake tool of FIG. 13A.

In American-style embodiments, the safety key typically projects from the top of the tool's shank and engages a shelf 16.3 of the tool holder. Typically, this shelf defines a horizontal surface of a safety slot 100 within the channel C defined by the tool holder TH, as shown in FIG. 12A. In some cases, the shelf 16.3 is formed by an upwardly-facing shoulder of the tool holder, which shoulder has an upwardly-facing surface (defined by the shelf 16.3) spaced upwardly from a downwardly-facing, force-delivering shoulder X of the tool holder. Typically, this force-delivering shoulder X is adjacent the bottom of the channel C and defines a downwardly-facing surface B'.

Preferably, the safety key K is biased toward an extended position when the shank S is moved to an operative position in the channel C of the tool holder. Thus, when the shank is moved to its operative position in the channel, the safety key preferably is biased toward, and thereby moved into, its extended position. This can be accomplished in various different ways. In some cases, the safety key is resiliently biased toward its extended position. The safety key, for example, can be operatively coupled to a spring member that applies to the safety key a force biasing the safety key toward its extended position. The spring member can be coupled with the safety key in such a way that this force is a constant force (i.e., one applied at all times), or in such a way that this force is only applied when the shank is moved into its operative position in the channel. In certain alternate embodiments, there is provided a safety key that is adapted to pivot into an extended position as a result of contact between the safety key and a wall (e.g., corner 300) of the tool holder when the tool is moved upwardly into the channel C. Various embodiments of this nature can be provided.

Thus, certain embodiments provide a spring member 40 that biases the safety key K toward its extended position. Embodiments of this nature are perhaps best understood with reference to FIGS. 3, 4, 7, 8, and 9. FIG. 9 depicts what is perhaps the simplest embodiment of this nature. Here, the tool's shank is provided with a blind bore 70 in which the safety key K is mounted. In FIG. 9, the closed end (i.e., the back) of the blind bore 70 is defined by wall 75. This wall can be defined by the body B of the shank S itself, or by a plug assembly (not shown) mounted in one end of the bore 70 (in which case the bore 70 can be formed as a through-hole and then closed at one end with the plug assembly). The spring member 40 is thus compressed between the wall 75 and the safety key K and therefore biases the safety key K toward its extended position. Generally, any spring member 40 can be used in the present tool, e.g., any conventional spring of appropriate size, shape, spring constant, and construction. In FIG. 9, the blind bore 75 is not open to any further bore(s) branching out elsewhere through the body B of the shank S. Rather, the illustrated blind bore 70 has only a single length extending laterally between a closed end defined by wall 75 and its opening through the side of the shank. This, of course, is by no means required.

Preferably, the safety key is mounted slidably in the bore 70, such that it K is free to move laterally in the bore between its retracted and extended positions. Lateral movement of the safety key K, however, is desirably limited so that the safety key is prevented from falling out of the bore 70 and off the tool. This can be accomplished in various ways. For example, the spring member 40 can be attached at one end to the wall 75 and attached at the other end to the safety key. Alternatively, the body B of the tool's shank may define a lip (not shown), adjacent the bore's opening, that extends inwardly somewhat into the bore 70 and defines a stop, which limits the movement of the safety key. In embodiments of this nature, the spring 40 can only push the safety key K laterally away from the center of the tool's shank until a shoulder (not shown) on the safety key butts up against this lip, at which point the safety key will have reached its extended position.

Figure 8:
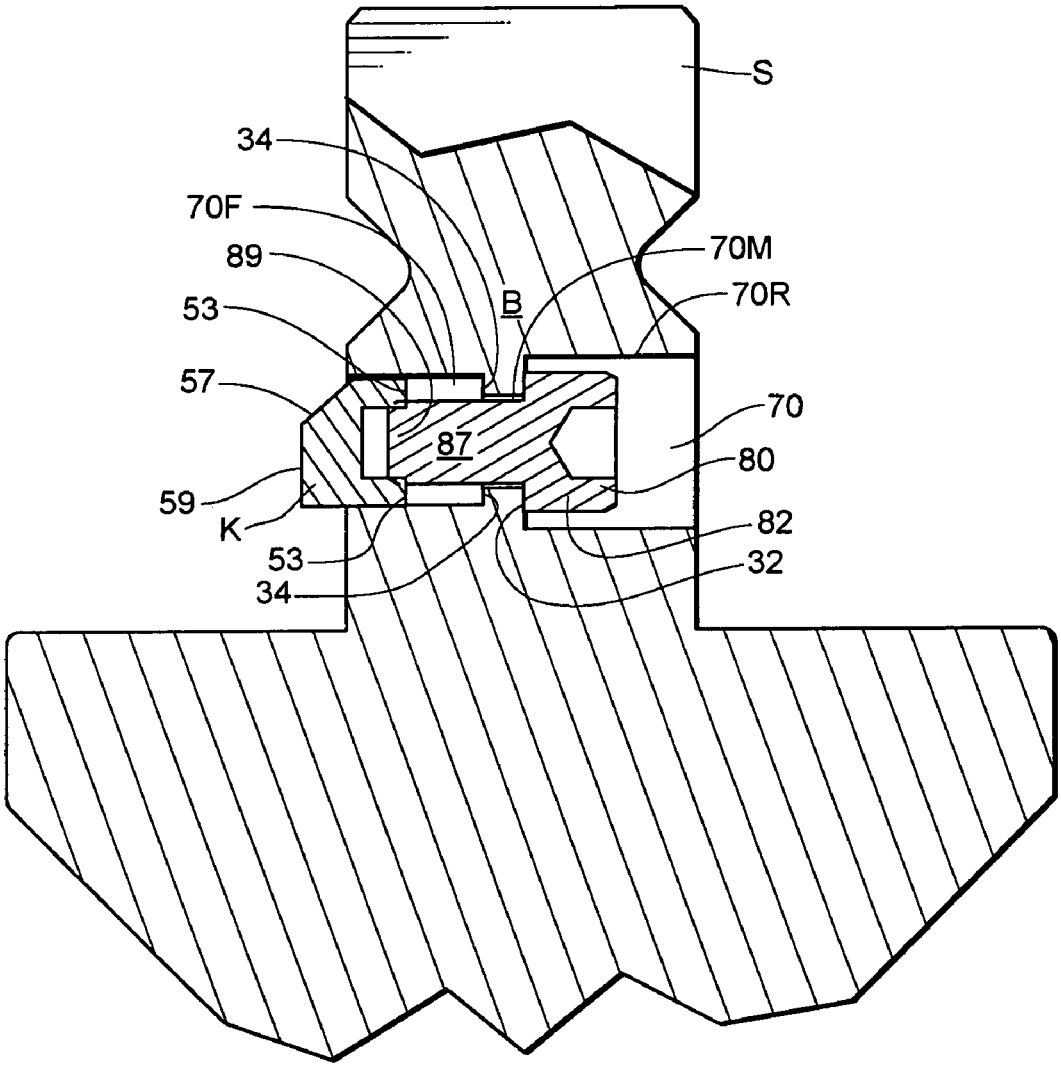
FIG. 8 is a partially broken away cross sectional side view of a press brake tool in accordance with certain embodiments of the invention.
Figure 9:
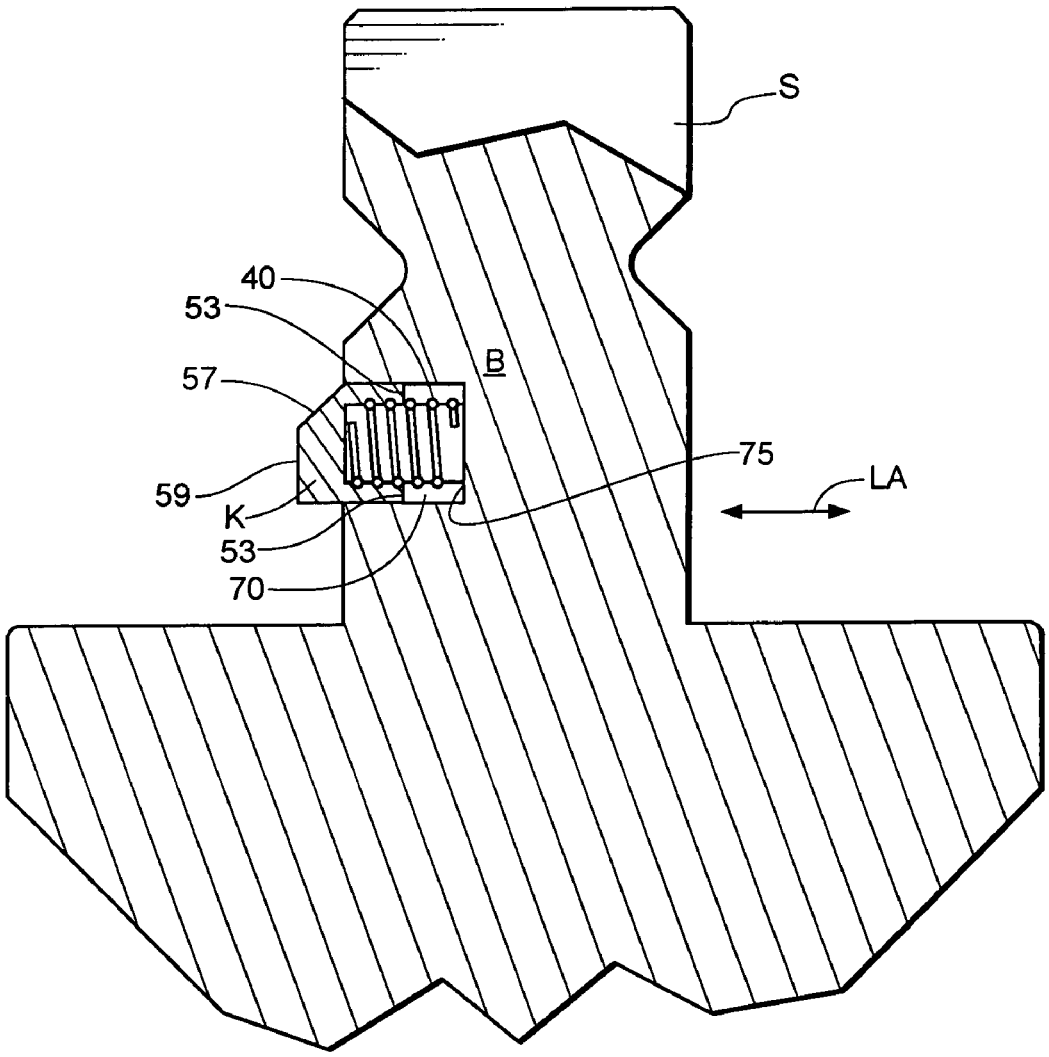
FIG. 9 is a partially broken away cross sectional side view of a press brake tool in accordance with certain embodiments of the invention.

FIGS. 3, 4, 7, and 8 exemplify further embodiments wherein the safety key K is resiliently biased toward its extended position. Here again, the safety key K is mounted slidably in a bore 70. In these embodiments, however, the safety key is coupled to one or more posts 87. In FIGS. 3, 4, 7, and 8, the safety key is coupled with two posts 87 defined respectively by two bolt members 80. Here, the bolt members 80 have necks each defining a post 87. Each bolt member 80 has a head 82 at one end, and a neck 87 extending away from the head 82 and terminating at an opposite, leading end 89 of the bolt member 80. The head 82 of each bolt member 80 has a larger dimension (e.g., a larger diameter) than the neck 87. As is perhaps best shown in FIG. 8, the body B of the tool's shank S has therein formed a bore 70, which preferably extends entirely through the shank S. In the embodiments exemplified by FIG. 8, this bore 70 has a front region 70F, at least one rear region 70R, and two intermediate regions 70M extending substantially in parallel between the front and rear bore regions. Each of the two intermediate bore regions 70M is more narrow (e.g., has a smaller interior dimension) than the front 70F and rear 70R bore regions. Preferably, each narrow intermediate bore region 70M is configured (i.e., sized and shaped) to slidably receive the post 87 of a bolt member 80, while the head 82 of the bolt member 80 is larger than this bore region 70M and cannot pass through it 70M. Thus, when the neck 87 of the bolt member 80 is extended through the narrow intermediate bore region 70M (e.g., by inserting the bolt 80 neck first into the rear bore region 70R and through the narrow bore region 70M so that the leading end 89 of the neck 87 extends into the front bore region 70F), the head 82 of the bolt member 80 catches on a shoulder 32 defined by the shank body B. In FIG. 8, the leading end 89 of each bolt member 80 is fixedly secured to the safety key K, and a spring member 40 (which may be disposed longitudinally between the two necks 87) is compressed between the safety key K and a shoulder 34 defined by the shank body B. Thus, it can be appreciated that the safety key here is attached (e.g., rigidly) to the leading ends 89 of the bolt members 80 such that the safety key and the bolt members are movable (laterally) together as an integral unit, and the spring member 40 biases the safety key toward the extended position and thereby tends to move the safety key and the bolt members toward the extended position until the heads 82 of the bolt members reach the shoulder 32, at which point the safety key has reached its fully extended position and is prevented from further lateral movement in that direction. Similarly, by forcing the safety key toward its retracted position (overcoming the bias of the spring member), the safety key can be moved toward its retracted position until the rear 53 of the safety key K reaches the shoulder 34, at which point the safety key has reached its fully retracted position and is prevented from further lateral movement in that direction.

Figure 5:
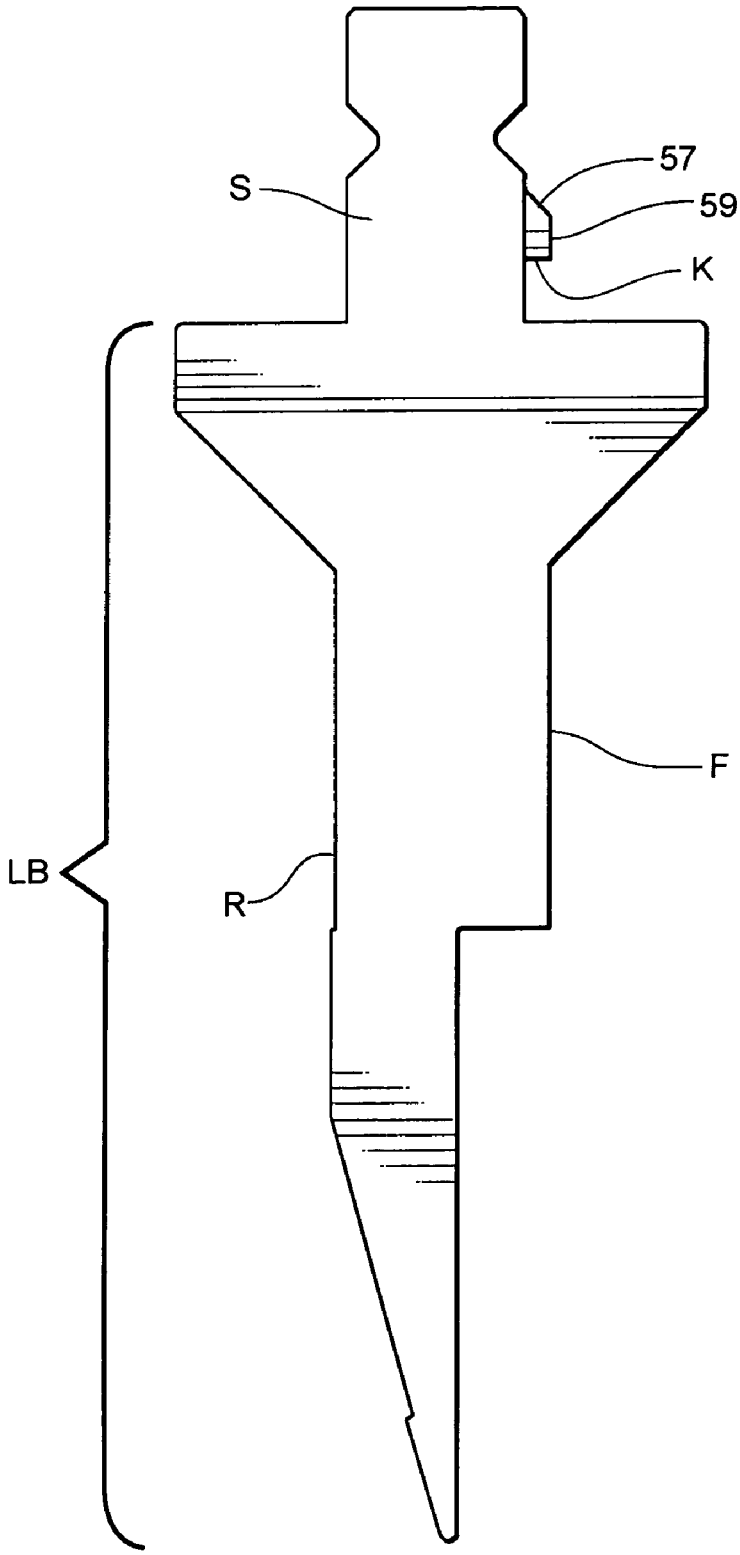
FIG. 5 is a side view of the press brake tool of FIG. 1.
Figure 6:
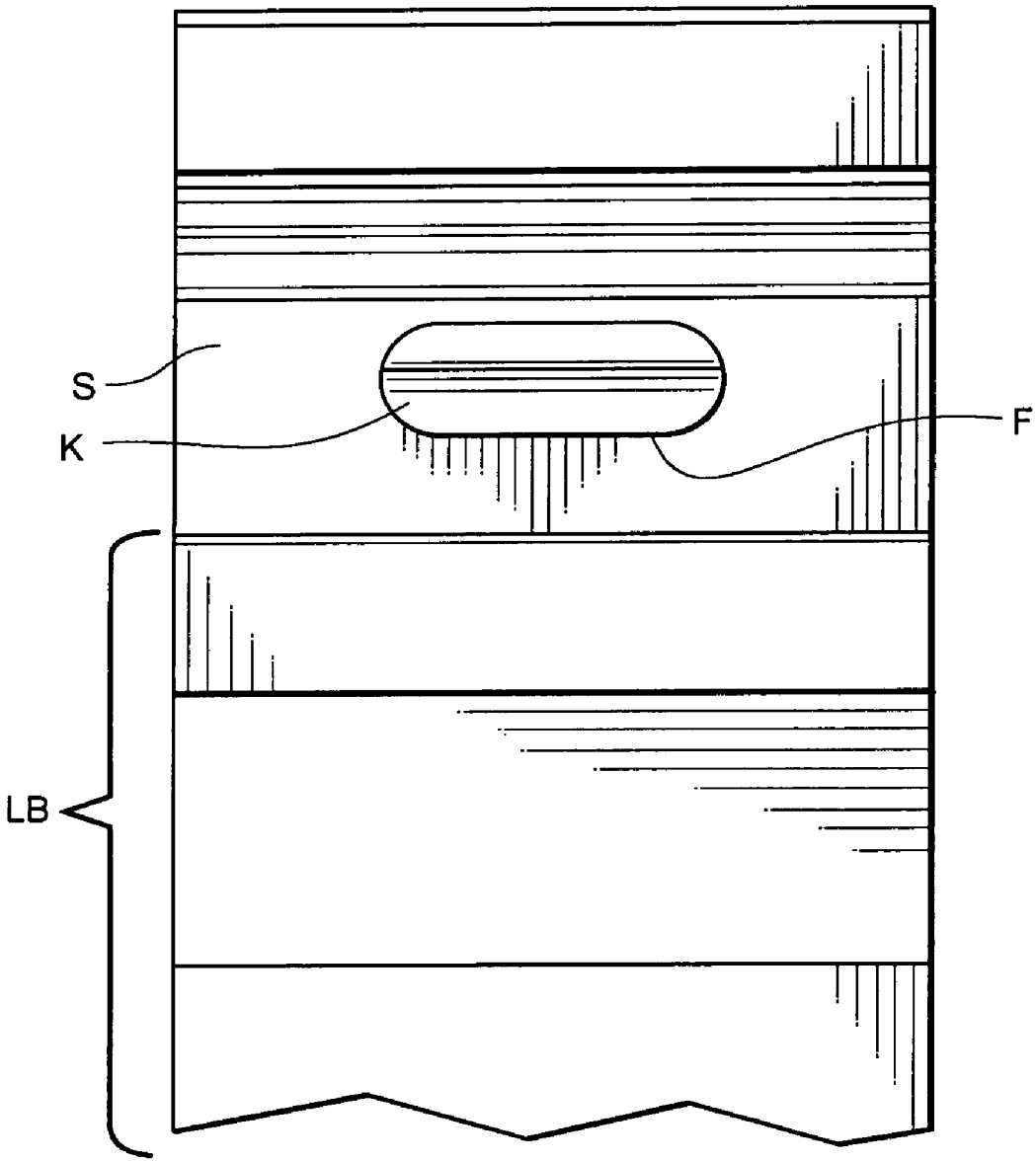
FIG. 6 is a partially broken away front view of the tool of FIG. 1.
Figure 7:
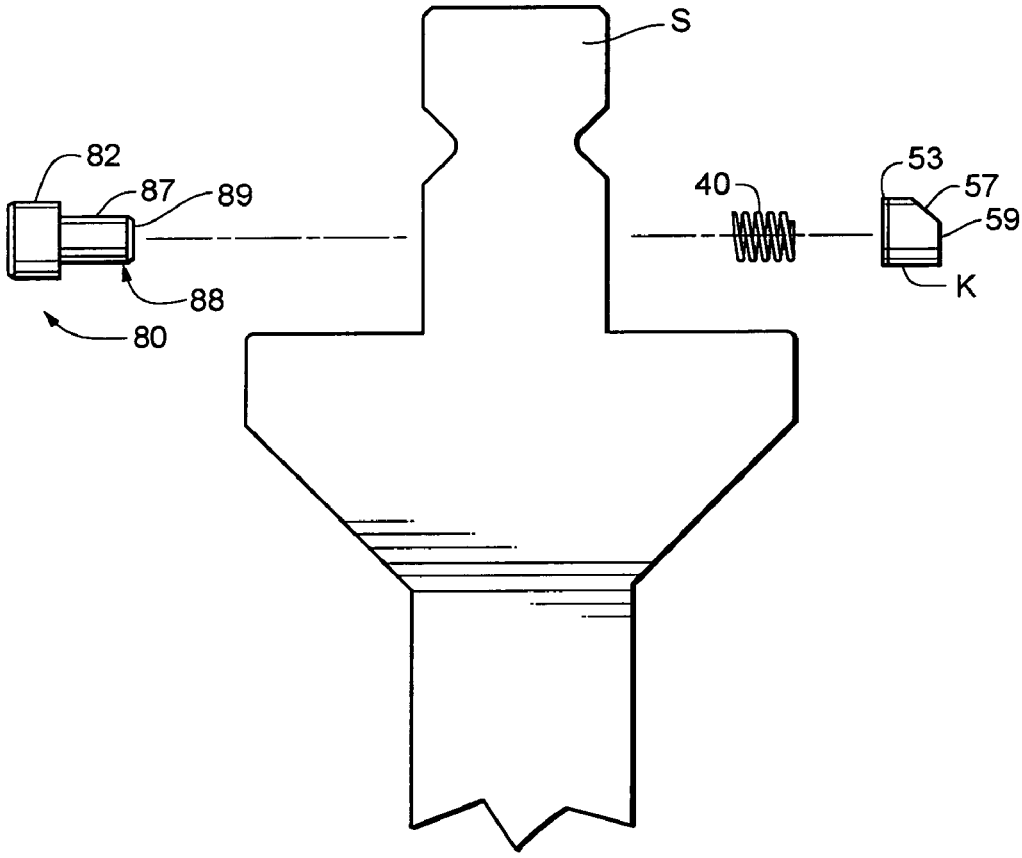
FIG. 7 is a partially broken away exploded side view of a press brake tool in accordance with certain embodiments of the invention.
Figure 10:
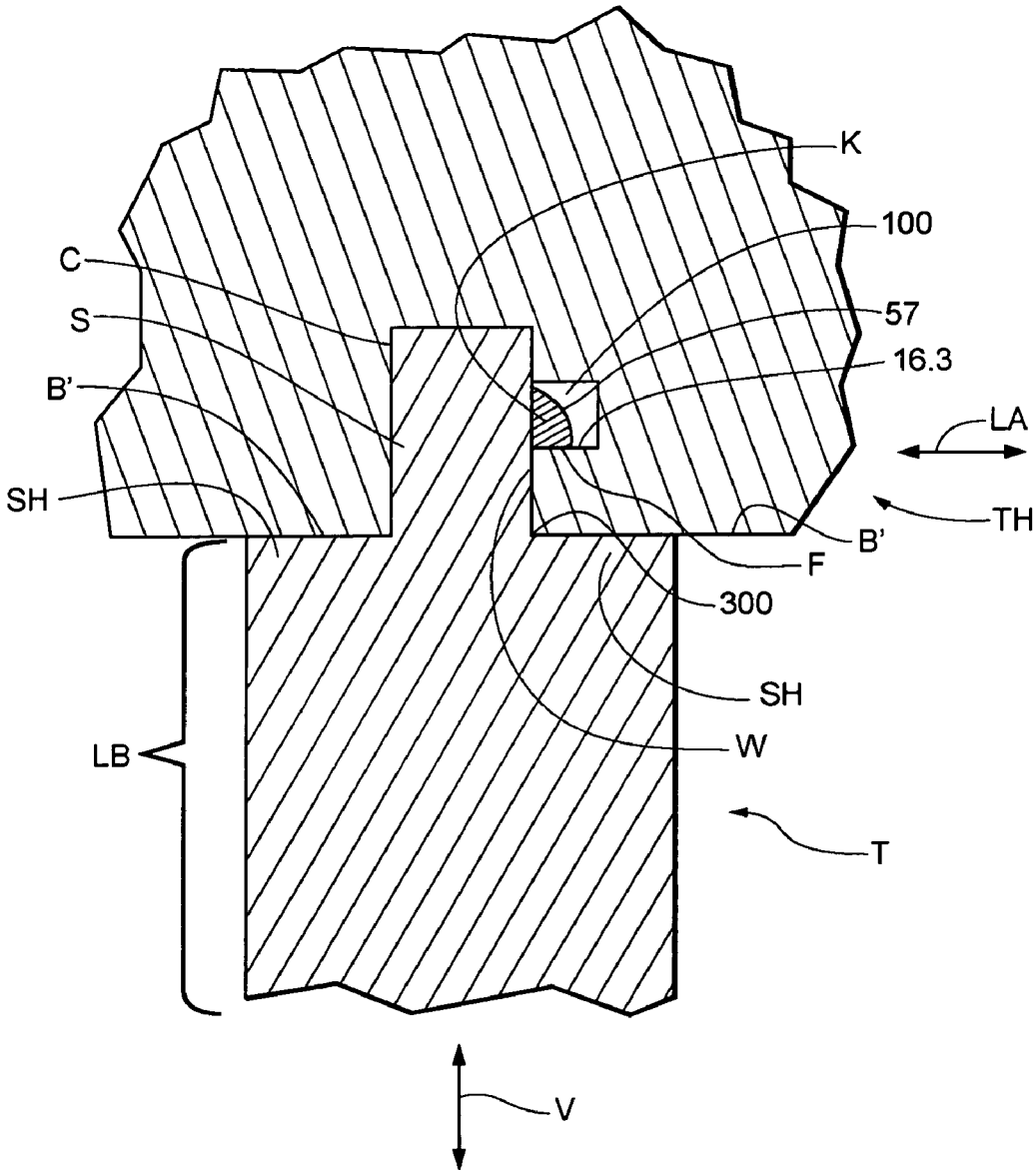
FIG. 10 is a broken away cross sectional side view of a press brake tool and a tool holder, in combination, where the tool is mounted for use on the holder in accordance with certain embodiments of the invention.

The safety key has an engagement portion that is adapted for engaging the tool holder (e.g., by extending into a safety slot 100 of the tool holder and/or by moving into vertical alignment with a shelf 16.3 of the tool holder). Typically, the engagement portion of the safety key K is a distal end region thereof, which distal end region terminates (and defines) a distal end 59 of the safety key. Preferably, the engagement portion has a tapered leading region 57. This tapered region 57 defines a surface that may be radiused (as shown in FIG. 10) or at a straight angle (as shown in FIG. 5). The tapered leading region 57 facilitates advancing the tool into the tool holder, as described below. Preferably, the engagement portion of the safety key defines both the tapered leading region 57 and a planar trailing region (which preferably forms a flat F).

As noted above, the present tool T is not adapted for being dismounted from the tool holder by moving the tool vertically out of the channel. Rather, this tool is adapted to prevent such vertical dismounting. In certain embodiments, this is accomplished by providing a tool that has no externally accessible actuator for retracting the safety key. Thus, once the tool's shank is moved into its operative position in the channel of the tool holder a press brake operator is prevented from retracting the safety key and removing the tool vertically from the tool holder. As a result, the tool T is designed to prevent vertical removal and to only allow removal by sliding the tool lengthwise (i.e., longitudinally, along axis LO) out of the channel C of the tool holder.

In certain preferred embodiments, the tool T has a leading body portion LB that terminates at the tip of the tool. As is perhaps best seen in FIG. 10, the leading body portion LB is that portion of the tool that is not concealed (i.e., is left exposed) by the tool holder TH when the tool's shank S is in its operative position in the channel C of the tool holder. Preferably, either the leading body portion LB (or at least the front F and rear R sides of this portion LB) of the tool is defined entirely by solid wall having no openings, or any opening defined by a wall of the leading body portion (or at least any opening in the front F or rear R sides of this portion LB) is closed by a cover fixedly secured to the tool (e.g., wherein the cover is a rigid plug secured in a stationary position on the tool so as to block such opening).

Figure 14A:
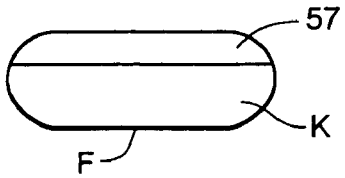
FIG. 14A is a front view of a safety key in accordance with certain embodiments of the invention.
Figure 14B:
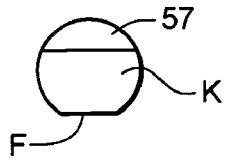
FIG. 14B is a front view of a safety key in accordance with certain other embodiments of the invention.

In certain preferred embodiments, the safety key K defines a flat F that is adapted to slide along a planar beam surface of the tool holder when the tool is dismounted from the tool holder by moving the tool horizontally(e.g., longitudinally) out of the channel. In these preferred embodiments, the flat F (which in some embodiments defines a downwardly-facing surface, e.g., a surface oriented toward the tip of the tool) is provided to reduce any beam gouging that may result from such sliding. As is perhaps best seen in FIGS. 14A–14B, the safety key K here has a flat F defining a contact surface that creates more than a single point of contact with the planar beam surface along which the flat slides when the tool is moved horizontally out of the channel C. Preferably, the flat F defines an elongated contact surface having a longitudinal length of at least about 0.008 inch, and ranging up to the full longitudinal length of the tool. The length of the contact surface on the safety key can be varied to suit the requirements of different applications. Generally, larger tools will benefit from broader contact surfaces.

Figure 11:
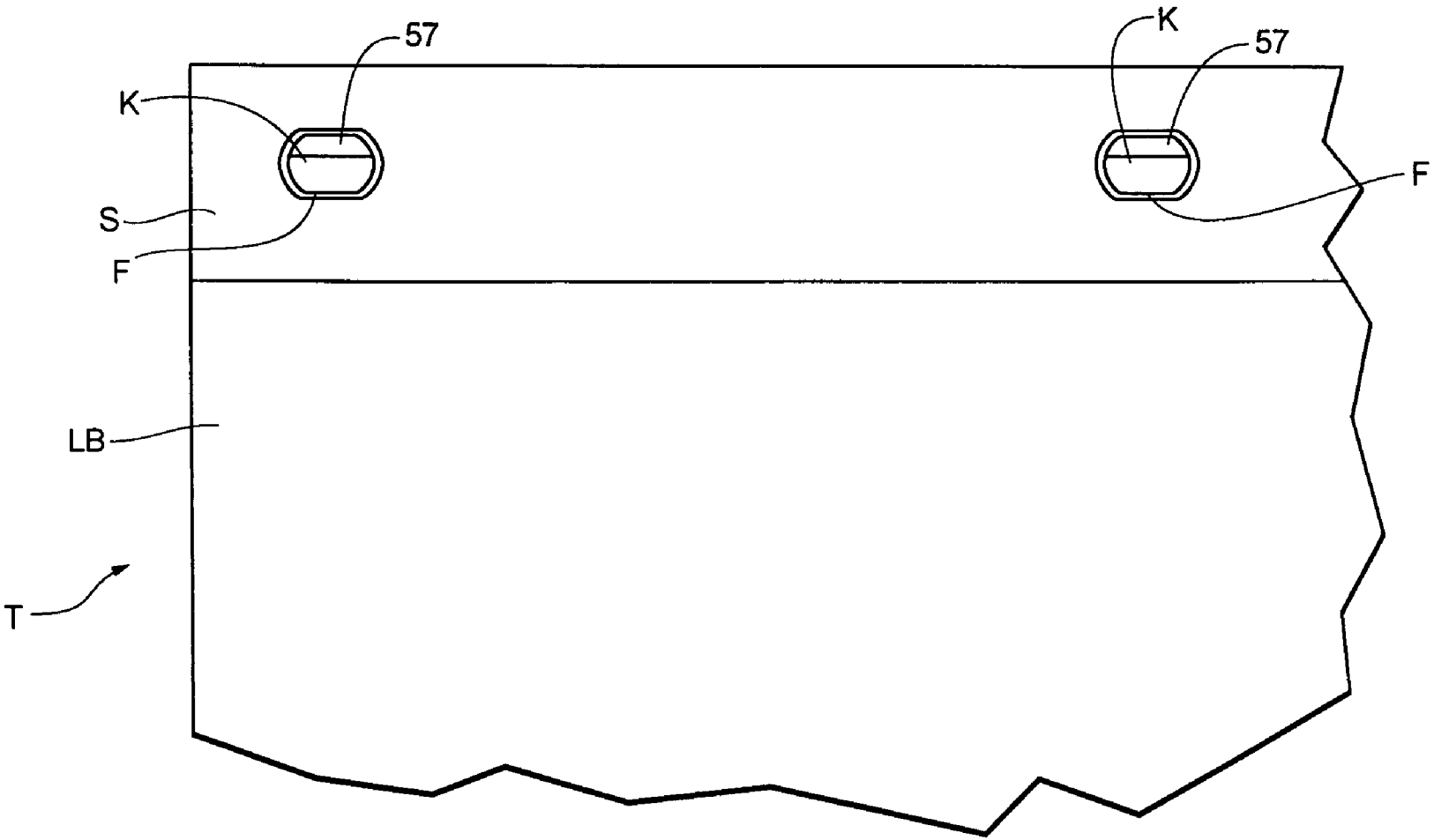
FIG. 11 is a partially broken away front view of a press brake tool in accordance with certain embodiments of the invention.

In certain embodiments, the tool's shank S is provided with a plurality of safety keys K spaced along a longitudinal length of the shank S, wherein each safety key defines a flat F that is adapted to slide along a planar beam surface of the tool holder when the tool is dismounted from the tool holder by moving the tool horizontally out of the channel. FIG. 11 exemplifies embodiments of this nature.

In certain particularly preferred embodiments, the tool's shank S has a longitudinal length and the safety key K is an elongated retractable safety key. Embodiments of this nature are detailed in U.S. patent application Ser. No. 10/611,181, the entire teachings of which are incorporated herein by reference. Preferably, the elongated retractable safety key spans a major portion (e.g., 50% or more) of the longitudinal length of the tool's shank. Certain preferred embodiments of this nature are depicted in FIGS. 13A–F. The elongated safety key shown in these figures spans (e.g., comprises a single integral body spanning) substantially the entire longitudinal length of the tool's shank. Thus, the invention provides certain embodiments wherein the press brake tool is adapted for being mounted in a tool holder by securing a shank of the tool in a channel defined by the tool holder, wherein the tool's shank is provided with a retractable safety key, and wherein the tool's shank has a longitudinal length and the retractable safety key comprises a single integral body spanning substantially the entire longitudinal length of the shank.

In the foregoing embodiments, the safety key can have a highly desirable one-piece construction (i.e., the safety key can be a single integral body or "tang"). As noted above, this safety key is retractable. That is, it is mounted on the tool for movement between extended and retracted positions. An elongated retractable safety key of this nature can be used in a variety of different tool designs.

In certain preferred embodiments, the invention provides a tool having no externally accessible actuator for retracting the safety key and, in combination, having a safety key defining a flat that is adapted to slide along a planar surface of the tool holder when the tool is dismounted from the tool holder by moving the tool horizontally out of the channel. These embodiments are desirable in that they provide a click-in/slide-out tool wherein dismounting is less likely to result in beam gouging because of the flat on the safety key, which flat defines a longitudinally-elongated contact surface that is less likely to gouge the beam (or any other surface of the tool holder on which the safety key is adapted to slide) during sliding than the single point of contact that would result if the safety key were simply a round dowel.

FIG. 10 depicts the operative position of the shank S, and the extended position of the safety key K, in certain embodiments. Here, the tool T is shown mounted in the tool holder TH and ready for use. As exemplified in FIG. 10, certain embodiments provide a tool holder and a press brake tool in combination. Here, the tool T has a shank S mounted in a channel C defined by the tool holder. The shank S has a retractable safety key K, which in FIG. 10 is in the extended position and is engaged with a safety slot 100 defined by the tool holder. In the present embodiments, the tool preferably has no externally accessible actuator for retracting the safety key, such that an operator is prevented from retracting the extended safety key to remove the thus operatively positioned tool vertically from the tool holder. In certain embodiments of this nature, either the tool has a leading body portion LB that is defined entirely by solid wall having no openings, or any opening defined by a wall of the leading body portion LB is closed by a cover fixedly secured to the tool, as described above.

The mounting and dismounting of the tool will now be described in detail. The ensuing discussion focuses on embodiments wherein the tool is mounted on the upper table of a press brake (e.g., on the upper beam of a press brake, or in an adaptor mounted on the upper beam of the press brake). It will be understood, of course, that the tool can just as well be mounted on the lower table of a press brake (e.g., on the lower beam of a press brake, or in an adaptor mounted on the lower beam). As noted above, the engagement portion of the safety key K preferably has a tapered leading region 57 and a generally-planar trailing region (which desirably forms a flat F). The tool is mounted by advancing it upwardly toward the downwardly-open channel C of the tool holder TH. As the engagement portion of the safety key K approaches the channel C, the tapered leading region 57 of the safety key contacts a bottom corner 300 of the tool holder TH. This bottom corner 300 cams with the tapered leading region 57 of the safety key, causing the safety key to move into its retracted position as the tool is moved upwardly into the channel C. Once the trailing planar region of the safety key's engagement portion (and the flat F it desirably forms) is moved vertically beyond the tool holder's shelf 16.3, the biased safety key moves into its extended position, engaging the tool holder (e.g., moving into vertical alignment with the shelf 16.3). In certain embodiments, the safety key emits an audible "click" when it snaps into the slot 100. In embodiments like that shown in FIG. 10, load-receiving shoulders SH of the tool T are then substantially flush against the load-transmitting surfaces B' of the tool holder TH. When it is desired to dismount the tool T from the tool holder TH, the tool can be dismounted only by sliding it lengthwise (i.e., longitudinally) out of the tool holder (the tool, of course, should be gripped firmly by the operator during such dismounting).

Thus, the invention provides methods of press brake operation. In certain embodiments of this nature, the method comprises: (a) providing a press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted by moving the tool vertically out of the channel, the tool having a shank that is provided with a safety key, wherein the safety key is biased toward an extended position when the shank is moved to an operative position in the channel of the tool holder, and wherein the tool has no externally accessible actuator for retracting the safety key, such that once the tool's shank is moved into its operative position a press brake operator is prevented from retracting the safety key and removing the tool vertically from the tool holder; (b) providing a tool holder that defines a channel and a safety slot; and (c) mounting the press brake tool in the tool holder by moving the tool vertically into an operative position in the channel of the tool holder, such that the safety key is biased toward, and thereby moved into, an extended position wherein the safety key is engaged with the safety slot. In some cases, this method further comprises dismounting the tool from the tool holder by moving the tool horizontally out of the channel.

While preferred embodiments of the present invention have been described, it should be understood that a variety of changes, adaptations, and modifications can be made therein without departing from the spirit of the invention and the scope of the appended claims.

What is claimed is:

1. A press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted from the tool holder by moving the tool vertically out of the channel, the tool having a shank that is provided with a safety key, wherein the safety key is biased toward an extended position when the shank is moved to an operative position in the channel of the tool holder, and wherein the tool has no externally accessible actuator for retracting the safety key such that once the tool's shank is moved into its operative position in the channel of the tool holder a press brake operator is prevented from retracting the safety key and removing the tool vertically from the tool holder, wherein the tool has a leading body portion that terminates at a tip, the leading body portion being that portion of the tool that is not concealed by the tool holder when the shank is in its operative position in the channel of the tool holder, wherein the leading body portion of the tool is defined entirely by solid wall having no openings, wherein the tool includes a spring member that biases the safety key toward said extended position, wherein the safety key defines a flat that is adapted to slide along a planar surface of the tool holder when the tool is dismounted from the tool holder by moving the tool horizontally out of the channel, wherein the flat reduces gouging of said planar surface resulting from such sliding.

2. The press brake tool of claim 1 wherein the flat defines an elongated contact surface having a longitudinal length of at least about 0.008 inch.

3. The press brake tool of claim 1 wherein the tool's shank is provided with a plurality of safety keys spaced along a longitudinal length of the tool's shank, wherein each safety key defines a flat that is adapted to slide along a planar surface of the tool holder when the tool is dismounted from the tool holder by moving the tool horizontally out of the channel.

4. The press brake tool of claim 1 wherein the tool's shank has a longitudinal length and the safety key is an elongated safety key spanning 50% or more of the longitudinal length of the tool's shank.

5. The press brake tool of claim 4 wherein the elongated safety key comprises a single integral body spanning substantially an entirety of the longitudinal length of the tool's shank.

6. The press brake tool of claim 1 wherein the flat defines an elongated contact surface having a longitudinal length of at least about 0.015 inch.

7. The press brake tool of claim 1 wherein the flat defines an elongated contact surface having a longitudinal length of at least about 0.020 inch.

8. A press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted by moving the tool vertically out of the channel, the tool having a shank that is provided with a safety key, wherein the safety key is biased toward an extended position when the shank is moved to an operative position in the channel of the tool holder, wherein the tool has no externally accessible actuator for retracting the safety key such that once the tool's shank is moved into its operative position a press brake operator is prevented from retracting the safety key and removing the tool vertically from the tool holder, and wherein the safety key defines a flat that is adapted to slide along a planar surface of the tool holder when the tool is dismounted from the tool holder by moving the tool horizontally out of the channel.

9. A press brake tool that is adapted for being mounted in a tool holder by securing a shank of the tool in a channel defined by the tool holder, wherein the tool's shank is provided with a retractable safety key, and wherein the tool's shank has a longitudinal length and the retractable safety key spans substantially an entirety of the longitudinal length of the tool's shank.

10. A method of press brake operation, the method comprising:

a) providing a press brake tool that is adapted for being mounted into a tool holder by moving the tool vertically into a channel defined by the tool holder, wherein the tool is adapted for being dismounted from the tool holder by moving the tool horizontally out of the channel, and wherein the tool is not adapted for being dismounted by moving the tool vertically out of the channel, the tool having a shank that is provided with a safety key, wherein the safety key is biased toward an extended position when the shank is moved to an operative position in the channel of the tool holder, and wherein the tool has no externally accessible actuator for retracting the safety key, such the once the tool's shank is moved into its operative position a press brake operator is prevented from retracting the safety key and removing the tool vertically from the tool holder, wherein the safety key defines a flat that is adapted to slide along a planar surface of the tool holder when the tool is dismounted from the tool holder by moving the tool horizontally out of the channel;

b) providing a tool holder that defines a channel and a safety slot; and c) mounting a press brake tool in the tool holder by moving the tool vertically into an operative position in the channel of the tool holder, such that the safety key is biased toward and thereby moved into an extended position wherein the safety key is engaged with the safety slot;

the method further comprising dismounting the tool from the holder by sliding the tool horizontally out of the channel, wherein the flat reduces gouging of said planar surface resulting from such sliding.

11. A press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted by moving the tool vertically out of the channel, the tool having a shank that is provided with a safety key, wherein the safety key is biased toward an extended position when the shank is moved to an operative position in the channel of the tool holder, wherein the tool has no externally accessible actuator for retracting the safety key such that once the tool's shank is moved into its operative position a press brake operator is prevented from retracting the safety key and removing the tool vertically from the tool holder, wherein the safety key is not a round dowel but rather defines a flat forming a longitudinally-elongated contact surface that is adapted to slide along a planar surface of the tool holder when the tool is dismounted from the tool holder by moving the tool horizontally out of the channel.

12. A press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted from the tool holder by moving the tool vertically out of the channel, the tool having a shank that is provided with a safety key, wherein the safety key is biased toward an extended position when the shank is moved to an operative position in the channel of the tool holder, and wherein the tool has no externally accessible actuator for retracting the safety key such that once the tool's shank is moved into its operative position in the channel of the tool holder a press brake operator is prevented from retracting the safety key and removing the tool vertically from the tool holder, wherein the tool has a leading body portion that terminates at a tip, the leading body portion being that portion of the tool that is not concealed by the tool holder when the shank is in its operative position in the channel of the tool holder, wherein the leading body portion of the tool is defined entirely by solid wall having no openings, wherein the tool includes a spring member that biases the safety key toward said extended position, wherein the tool has a leading body portion that terminates at a tip, the leading body portion being that portion of the tool that is not concealed by the tool holder when the shank is in its operative position in the channel of the tool holder, wherein any opening defined by a wall of the leading body portion is closed by a cover fixedly secured to the tool.

13. A press brake tool and a tool holder in combination, wherein the press brake tool has a shank mounted in a channel defined by the tool holder, the shank having a retractable safety key, the safety key being in an extended position and being engaged with a safety slot defined by the tool holder, wherein the tool has no externally accessible actuator for retracting the thus extended safety key such that a press brake operator is prevented from retracting the safety key and removing the thus operatively positioned tool vertically from the tool holder, wherein the tool has a leading body portion that terminates at a tip, the leading body portion being that portion of the tool that is not concealed by the tool holder, wherein any opening defined by a wall of the leading body portion is closed by a cover fixedly secured to the tool.

14. A press brake tool that is adapted for being mounted in a tool holder by moving the tool vertically into a channel defined by the tool holder, wherein the tool is adapted for being dismounted from the tool holder by moving the tool horizontally out of the channel, and wherein the tool is not adapted for being dismounted from the tool holder by moving the tool vertically out of the channel, the tool having a shank, the shank having two opposed sides each having formed therein a longitudinally extending groove, the shank having only a single safety key, wherein said safety key when in its extended position projects from a single one of said two sides of the tool's shank, wherein the safety key is biased toward an extended position when the shank is moved to an operative position in the channel of the tool holder, and wherein the tool has no externally accessible actuator for retracting the safety key such that once the tool's shank is moved into its operative position in the channel of the tool holder a press brake operator is prevented from retracting the safety key and removing the tool vertically from the tool holder, wherein the tool has a leading body portion that terminates at a tip, the leading body portion being that portion of the tool that is not concealed by the tool holder when the shank is in its operative position in the channel of the tool holder, wherein the leading body portion of the tool is defined entirely by solid wall having no openings, wherein the tool includes a spring member that biases the safety key toward said extended position, the safety key having an engagement portion with a tapered leading region that facilitates advancing the tool into said channel, the safety key's engagement portion having a planar trailing region, wherein the trailing planar region of the safety key's engagement portion defines a flat that is adapted to slide along a planar surface of the tool holder when the tool is dismounted from the tool holder by moving the tool horizontally out of the channel, wherein the flat reduces gouging of said planar surface resulting from such sliding.

* * * * *

UNITED STATES PATENT AND TRADEMARK OFFICE

CERTIFICATE OF CORRECTION

PATENT NO. : 7,021,116 B2
APPLICATION NO. : 10/742439
DATED : April 4, 2006
INVENTOR(S) : Heath E. Harrington et al.

It is certified that error appears in the above-identified patent and that said Letters Patent is hereby corrected as shown below:

Claim 10, col. 12, line 15, delete "such the once" and insert --such that once--.

Claim 12, col. 13, lines 23-27, delete "wherein the tool has a leading body portion that terminates at a tip, the leading body portion being that portion of the tool that is not concealed by the tool holder when the shank is in its operative position in the channel of the tool holder,".

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,021,116 B2
APPLICATION NO. : 10/742439
DATED : April 4, 2006
INVENTOR(S) : Heath E. Harrington et al.

It is certified that error appears in the above-identified patent and that said Letters Patent is hereby corrected as shown below:

Claim 10, Col. 13 line 15, delete "such the once" and insert --such that once--.

Claim 12, Col. 13 lines 23-27, delete "wherein the tool has a leading body portion that terminates at a tip, the leading body portion being that portion of the tool that is not concealed by the tool holder when the shank is in its operative position in the channel of the tool holder,".

Signed and Sealed this

Seventeenth Day of April, 2007

JON W. DUDAS
*Director of the United States Patent and Trademark Office*